US009520089B2

(12) United States Patent
Kim et al.

(10) Patent No.: US 9,520,089 B2
(45) Date of Patent: Dec. 13, 2016

(54) LIQUID CRYSTAL DISPLAY DEVICE AND METHOD OF DRIVING THE SAME

(71) Applicant: LG Display Co., Ltd., Seoul (KR)

(72) Inventors: Min-Beom Kim, Seoul (KR); Jae-Sung Jeon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 186 days.

(21) Appl. No.: 14/080,653

(22) Filed: Nov. 14, 2013

(65) Prior Publication Data

US 2014/0152720 A1 Jun. 5, 2014

(30) Foreign Application Priority Data

Dec. 4, 2012 (KR) ..... 10-2012-0139596

(51) Int. Cl.
*G09G 3/36* (2006.01)
*G09G 3/34* (2006.01)

(52) U.S. Cl.
CPC ..... *G09G 3/3406* (2013.01); *G09G 3/3648* (2013.01); *G09G 2320/064* (2013.01); *G09G 2320/0646* (2013.01); *G09G 2360/16* (2013.01)

(58) Field of Classification Search
CPC ..... G09G 2320/064; G09G 2320/0646; G09G 3/3406; G09G 3/3648; G09G 2360/16
USPC ..... 345/102, 690, 691
See application file for complete search history.

(56) References Cited

U.S. PATENT DOCUMENTS

2006/0055661 A1 3/2006 Kawaguchi
2008/0074372 A1* 3/2008 Baba ..... G09G 3/3406 345/89
2009/0140665 A1* 6/2009 Park ..... G09G 3/3426 315/291
2009/0251399 A1* 10/2009 Kim ..... G09G 3/3406 345/89

(Continued)

FOREIGN PATENT DOCUMENTS

CN 101290754 10/2008
CN 101345031 1/2009

(Continued)

OTHER PUBLICATIONS

First Office Action for Chinese Patent Application No. CN 201310629885.7, Jul. 23, 2015, 18 pages.

*Primary Examiner* — Amr Awad
*Assistant Examiner* — Aaron Midkiff
(74) *Attorney, Agent, or Firm* — Fenwick & West LLP

(57) ABSTRACT

Disclosed are a liquid crystal display device and a drive method thereof. The liquid crystal display device includes a liquid crystal panel having a plurality of pixel areas to display an image, a data driver configured to drive data lines of the liquid crystal panel, a dimming controller configured to generate a dimming value via modulation using any one value within the range from an average gray-level value to a maximum gray-level value of image data input from an external source, and output the image data via modulation and control drive time of a backlight unit based on the dimming value, a timing controller configured to allow transmission of the image data modulated by the dimming controller to the data driver, and to control the data driver, and the backlight unit configured to emit light to the liquid crystal panel in response to a drive signal from the dimming controller.

8 Claims, 7 Drawing Sheets

(56) References Cited

U.S. PATENT DOCUMENTS

| | | | | |
|---|---|---|---|---|
| 2012/0162276 | A1* | 6/2012 | Jang | G09G 3/3426 345/690 |
| 2014/0160181 | A1* | 6/2014 | Takeda | G09G 3/342 345/690 |

FOREIGN PATENT DOCUMENTS

| | | | |
|---|---|---|---|
| CN | 101739973 | A | 6/2010 |
| JP | 2002-304147 | | 10/2002 |

* cited by examiner

LIQUID CRYSTAL DISPLAY DEVICE AND METHOD OF DRIVING THE SAME

CROSS REFERENCE TO RELATED APPLICATION

This application claims the benefit of Korean Patent Application No. 10-2012-0139596, filed on Dec. 4, 2012, which is hereby incorporated by reference as if fully set forth herein.

BACKGROUND OF THE INVENTION

1. Field of the Invention

The present invention relates to a liquid crystal display device which achieves reduction of power consumption of a backlight unit via data modulation of an image to be displayed to enhance display resolution, and a method of driving the same, and more particularly to a liquid crystal display device which may maximize reduction efficacy of power consumption of a backlight unit while minimizing deterioration of display resolution and enhancing image quality, and a method of driving the same.

2. Discussion of the Related Art

Flat panel display devices gathering strength in recent years include liquid crystal display devices, field emission display devices, plasma display panels, organic light emitting diode display devices, and the like.

Among such flat panel display devices, liquid crystal display devices are being actively applied to laptop computers, desktop monitors, and mobile terminals owing to, e.g., excellent resolution, color representation, image quality thereof.

A typical liquid crystal display device includes a liquid crystal panel having a plurality of liquid crystal cells to display an image, a drive circuit to drive the liquid crystal panel, and a backlight unit to emit light to the liquid crystal panel.

The liquid crystal panel displays a desired image via regulation of transmittance of light emitted from the backlight unit according to an image signal. In this case, the backlight unit drives a plurality of light sources included therein according to a light-source drive-control signal supplied from the drive circuit, to emit light to the liquid crystal panel.

The backlight unit driven as described above generates light having constant brightness at all times regardless of the image signal of the liquid crystal panel, which may increase power consumption.

For this reason, methods of reducing drive time of the backlight unit to reduce power consumption while maintaining quality of a display image are proposed in the related art. In particular, methods of regulating modulation of image data and drive time of the backlight unit according to an average gray level of display image data have been used.

However, in the case of using the average gray level of image data, image quality may be deteriorated due to gray-level saturation and gray-level banding according to image characteristics. Moreover, attempts to reduce deterioration of image quality may have a negative effect on efficiency control, thus having difficulty in reducing power consumption.

SUMMARY OF THE INVENTION

Accordingly, the present invention is directed to a liquid crystal display device and a method of driving the same that substantially obviate one or more problems due to limitations and disadvantages of the related art.

An object of the present invention is to provide a liquid crystal display device, which achieves reduction of power consumption of a backlight unit via data modulation of an image to be displayed to enhance display resolution, and more particularly may maximize reduction efficacy of power consumption of a backlight unit while minimizing deterioration of display resolution and enhancing image quality, and a method of driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a liquid crystal panel having a plurality of pixel areas to display an image, a data driver configured to drive data lines of the liquid crystal panel, a dimming controller configured to generate a dimming value via modulation using any one value within the range from an average gray-level value to a maximum gray-level value of image data input from an external source, and to output the image data via modulation and control drive time of a backlight unit based on the dimming value, a timing controller configured to allow transmission of the image data modulated by the dimming controller to the data driver, and to control the data driver, and the backlight unit configured to emit light to the liquid crystal panel in response to a drive signal from the dimming controller.

The dimming controller may include a data analyzer configured to detect the average gray-level value and the maximum gray-level value of image data input from the external source or the timing controller on a per at least one frame basis, a dimming value setter configured to output the dimming value via modulation on a per at least one frame basis using the average gray-level value, the maximum gray-level value, or any one value between the average gray-level value and the maximum gray-level value detected on a per at least one frame basis, a data modulator configured to generate modulated data by modulating the image data from the external source or the timing controller using the dimming value from the dimming value setter, and a Pulse Width Modulation (PWM) generator configured to generate the drive signal for conversion of a duty ratio based on the dimming value from the dimming value setter to thereby control drive time of the backlight unit.

The dimming value setter may generate the dimming value by dividing a differential value between the average gray-level value and the maximum gray-level value by the maximum gray-level value, multiplying a predetermined coefficient, and adding the average gray-level value as represented by the following Equation 1:

$$\text{dim}=[\{(\text{MAX}-APL)/255\}\times hyb_\text{coeff}]+APL \qquad \text{Equation 1}$$

(here, hyb_coeff being a coefficient predetermined based on experimental values), or the dimming value setter may generate the dimming value by dividing a differential value between the average gray-level value and the maximum gray-level value by the maximum gray-level value, extracting the square of the resulting value, multiplying a predetermined coefficient, and adding the average gray-level value as represented by the following Equation 2:

$$\text{dim}=[\{(\text{MAX}-APL)/255\}^2\times hyb_\text{coeff}]+APL. \quad \text{Equation 2}$$

Then, the dimming value setter may adjust the dimming value based on the above Equation 1 or Equation 2 by adjusting the maximum gray-level value using the following Equation 3:

$$\text{adj_MAX}=\text{MAX}-[\{(\text{MAX}-APL)/255\}^2\times(255-APL)]\times\text{adj_coeff} \quad \text{Equation 3}$$

(here, adj_MAX replacing the maximum gray-level value of Equation 1 or Equation 2), and the dimming value setter may generate the dimming value by replacing the maximum gray-level value of Equation 2 with the maximum gray-level value adjusted based on the above Equation 3 as proposed by the following Equation 4:

$$\text{dim}=[\{(\text{adj_MAX}-APL)/255\}^2\times hyb_\text{coeff}]+APL. \quad \text{Equation 4}$$

The dimming value setter may include predetermined first and second threshold values as reference values to differently select and apply setting of the dimming value according to the range within which the detected average gray-level value is included. If the detected average gray-level value is included within the range from a minimum gray-level value to the predetermined first threshold value, the dimming value setter may generate the dimming value using only the average gray-level value. If the detected average gray-level value is greater than the first threshold value and less than the predetermined second threshold value, the dimming value setter may generate the dimming value using the following Equation 5:

$$dim=\frac{\text{Result of Eq. 4}-APL}{\text{up_apl}-\text{lw_apl}}*(APL-\text{lw_apl})+APL. \quad \text{Equation 5}$$

If the detected average gray-level value is included within the range from the second threshold value to the maximum gray-level value (e.g., 255), the dimming value setter may generate the dimming value using the above Equation 4.

The dimming value setter may include predetermined third and fourth threshold values as reference values to differently select and apply setting of the dimming value according to the range within which the detected maximum gray-level value is included. If the detected maximum gray-level value is included within the range from the minimum gray-level value (zero gray-level) to the predetermined third threshold value, the dimming value setter may generate the dimming value using only the average gray-level value. If the detected maximum gray-level value is greater than the third threshold value and less than the fourth threshold value, the dimming value setter may generate the dimming value using the following Equation 6:

$$dim=\frac{\text{Results of Eq. 4 or Eq. 5}-APL}{\text{up_max}-\text{lw_max}}*(\text{MAX}-\text{lw_max})+APL. \quad \text{Equation 6}$$

If the detected maximum gray-level value is included within the range from the fourth threshold value to the maximum gray-level value (e.g., 255), the dimming value setter may generate the dimming value using the above Equation 4 or Equation 5.

In accordance with another aspect of the invention, a method of driving a liquid crystal display device, includes driving gate and data lines of a liquid crystal panel, generating a dimming value via modulation using any one value within the range from an average gray-level value to a maximum gray-level value of image data input from an external source or a timing controller, and outputting the image data via modulation and controlling drive time of a backlight unit based on the dimming value, allowing transmission of the modulated image data to a data driver, and controlling the data driver, and emitting light to the liquid crystal panel in response to a drive signal generated to control drive time of the backlight unit.

Outputting the image data via modulation and controlling drive time of the backlight unit may include detecting the average gray-level value and the maximum gray-level value of the image data on a per at least one frame basis, outputting the dimming value via modulation on a per at least one frame basis using the average gray-level value, the maximum gray-level value, or any one value between the average gray-level value and the maximum gray-level value detected on a per at least one frame basis, generating modulated data by modulating the image data using the output modulated dimming value, and generating the drive signal for conversion of a duty ratio based on the output modulated dimming value to thereby control drive time of the backlight unit.

Upon outputting the dimming value via modulation, the dimming value may be generated by dividing a differential value between the average gray-level value and the maximum gray-level value by the maximum gray-level value, multiplying a predetermined coefficient, and adding the average gray-level value as represented by the following Equation 1:

$$\text{dim}=[\{(\text{MAX}-APL)/255\}\times hyb_\text{coeff}]+APL \quad \text{Equation 1}$$

(here, hyb_coeff being a coefficient predetermined based on experimental values), or the dimming value maybe generated by dividing a differential value between the average gray-level value and the maximum gray-level value by the maximum gray-level value, extracting the square of the resulting value, multiplying a predetermined coefficient, and adding the average gray-level value as represented by the following Equation 2:

$$\text{dim}=[\{(\text{MAX}-APL)/255\}^2\times hyb_\text{coeff}]+APL. \quad \text{Equation 2}$$

Then, the dimming value based on the above Equation 1 or Equation 2 may be adjusted by adjusting the maximum gray-level value using the following Equation 3:

$$\text{adj_MAX}=\text{MAX}-[\{(\text{MAX}-APL)/255\}^2\times(255-APL)]\times\text{adj_coeff} \quad \text{Equation 3}$$

(here, adj_MAX replacing the maximum gray-level value of Equation 1 or Equation 2), and the dimming value may be generated by replacing the maximum gray-level value of Equation 2 with the maximum gray-level value adjusted based on the above Equation 3 as proposed by the following Equation 4:

$$\text{dim}=[\{(\text{adj_MAX}-APL)/255\}^2\times hyb_\text{coeff}]+APL. \quad \text{Equation 4}$$

Upon outputting the dimming value via modulation, based on predetermined first and second threshold values as reference values to differently select and apply setting of the dimming value according to the range within which the detected average gray-level value is included, the dimming value may be generated using only the average gray-level value if the detected average gray-level value is included within the range from a minimum gray-level value to the predetermined first threshold value. If the detected average gray-level value is greater than the first threshold value and less than the predetermined second threshold value, the dimming value may be generated using the following Equation 5:

$$dim = \frac{\text{Result of Eq. 4} - APL}{\text{up_apl} - \text{lw_apl}} * (APL - \text{lw_apl}) + APL, \quad \text{Equation 5}$$

and if the detected average gray-level value is included within the range from the second threshold value to the maximum gray-level value (e.g., 255), the dimming value may be generated using the above Equation 4.

Upon outputting the dimming value via modulation, based on predetermined third and fourth threshold values as reference values to differently select and apply setting of the dimming value according to the range within which the detected maximum gray-level value is included, the dimming value may be generated using only the average gray-level value if the detected maximum gray-level value is included within the range from the minimum gray-level value (zero gray-level) to the predetermined third threshold value. If the detected maximum gray-level value is greater than the third threshold value and less than the fourth threshold value, the dimming value may be generated using the following Equation 6:

$$dim = \frac{\text{Results of Eq. 4 or Eq. 5} - APL}{\text{up_max} - \text{lw_max}} * (\text{MAX} - \text{lw_max}) + APL, \quad \text{Equation 6}$$

and if the detected maximum gray-level value is included within the range from the fourth threshold value to the maximum gray-level value (e.g., 255), the dimming value may be generated using the above Equation 4 or Equation 5.

It is to be understood that both the foregoing general description and the following detailed description of the present invention are exemplary and explanatory and are intended to provide further explanation of the disclosure as claimed.

BRIEF DESCRIPTION OF THE DRAWINGS

The accompanying drawings, which are included to provide a further understanding of the invention and are incorporated in and constitute a part of this application, illustrate embodiment(s) of the disclosure and together with the description serve to explain the principle of the invention. In the drawings.

DETAILED DESCRIPTION OF THE INVENTION

Hereinafter, a liquid crystal display device and a method of driving the same according to an embodiment of the present invention having the above-described features will be described in detail with reference to the accompanying drawings.

Figure 1:
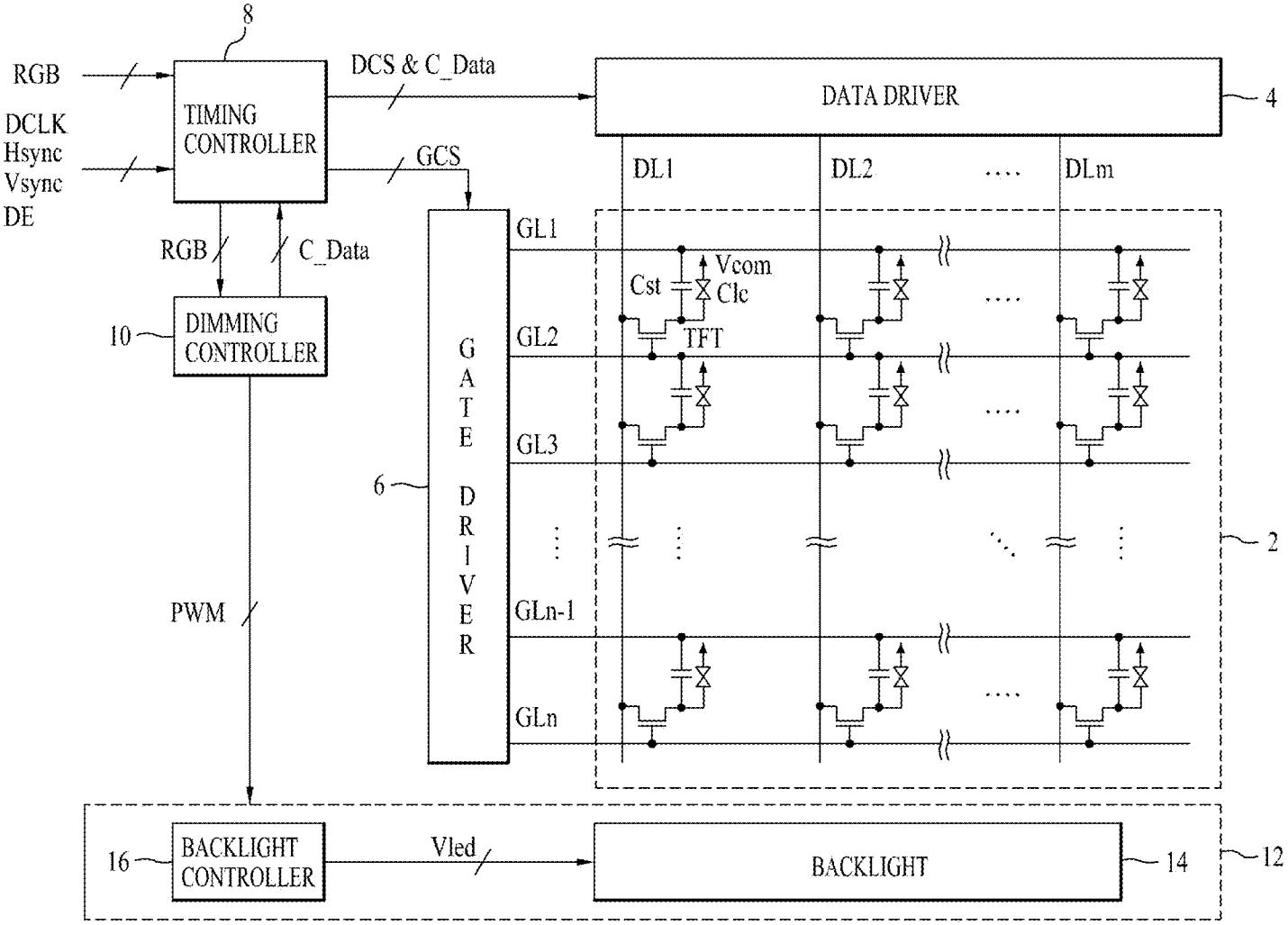
FIG. 1 is a view showing a configuration of a liquid crystal display device according to an embodiment of the present invention.

FIG. 1 is a view showing a configuration of a liquid crystal display device according to an embodiment of the present invention.

The liquid crystal display device as exemplarily shown in FIG. 1 includes a liquid crystal panel 2 having a plurality of pixel areas to display an image, a data driver 4 to drive data lines DL1 to DLm of the liquid crystal panel 2, a gate driver 6 to drive gate lines GL1 to GLn of the liquid crystal panel 2, a dimming controller 10 to generate a dimming value via modulation using any one value within the range from an average gray-level value to a maximum gray-level value of image data RGB input from an external source and output the image data via modulation and control drive time of a backlight unit 12 based on the dimming value, a timing controller 8 to allow transmission of the image data C_Data modulated by the dimming controller 10 to the data driver 4 and to control the data and gate drivers 4 and 6, and the backlight unit 12 to emit light to the liquid crystal panel 2 in response to a drive signal PWM from the dimming controller 10.

The liquid crystal panel 2 includes Thin Film Transistors (TFTs) formed at respective pixel areas defined by the plurality of gate lines GL1 to GLn and the plurality of data lines DL1 to DLm, and liquid crystal capacitors Clc connected to the TFTs. The liquid crystal capacitors CLc each include a pixel electrode connected to the TFT, and a common electrode facing the pixel electrode with liquid crystals interposed therebetween. The TFTs are configured to supply image signals from the respective data lines DL1 to DLm to the pixel electrodes in response to scan pulses from the respective gate lines GL1 to GLn. Each liquid crystal capacitor Clc is charged with a differential voltage between the image signal supplied to the pixel electrode and a common voltage supplied to the common electrode, and varies arrangement of liquid crystal molecules according to the differential voltage to regulate light transmittance, thereby realizing a gray-level. In addition, a storage capacitor Cst is connected in parallel to the liquid crystal capacitor CLc to maintain the voltage charged in the liquid crystal capacitor Clc until a next data signal is supplied.

The data driver 4 converts the image data C_Data modulated by the dimming controller 10 into analog image data, i.e. image signals using a Source Start Pulse (SSP) and a Source Shift Clock (SSC) among data control signals from the timing controller 8. In addition, the data driver 4 supplies image signals of one horizontal line to the respective data lines DL1 to DLm per one horizontal period during which scan pulses are supplied to the respective gate lines GL1 to GLn. In this case, the data driver 4 supplies the image signals to the respective data lines DL1 to DLm in response to a Source Output Enable (SOE) signal.

The gate driver 6 sequentially generate gate-on signals in response to a gate control signal GCS from the timing controller 8, e.g., a Gate Start Pulse (GSP) and a Gate Shift Clock (GSC), and controls a pulse width of the gate-on signals in response to a Gate Output Enable (GOE) signal. Then, the gate driver 6 sequentially supplies the gate-on signals to the gate lines GL1 to GLn. Here, gate-off voltage is supplied for a period during which gate-on voltage is not supplied to the gate lines GL1 to GLn.

The timing controller 8 aligns image data RGB input from the external source to conform to driving of the liquid crystal panel 2, and supplies the aligned image data RGB to the dimming controller 10. In addition, the timing controller 8 generates gate and data control signals GCS and DCS to control the gate and data drivers 4 and 6 respectively using at least one of synchronization signals supplied from an external source, i.e. dot-clock DCLK, data enable signal DE, and horizontal and vertical synchronization signals Hsync and Vsync.

The dimming controller 10 may be contained in the timing controller 8, or may be provided separately from the timing controller 8. For instance, if the dimming controller is contained in the timing controller 8, the dimming controller 10 generates a dimming value via modulation using any one value within the range from an average gray-level value to a maximum gray-level value of image data RGB input from the external source. Then, the dimming controller 10 modulates the input image data RGB using the output modulated dimming value, and supplies the same to the data driver 4. In addition, the dimming controller 10 generates a drive signal PWM via modulation based on the output modulated dimming value, and supplies the same to the backlight unit 12.

If the dimming controller 10 is provided separately from the timing controller 8, the dimming controller 10 generates a dimming value via modulation using any one value within the range from an average gray-level value to a maximum gray-level value of image data RGB directly input from the external source or input from the timing controller 8. Then, the dimming controller 10 modulates the input image data RGB using the output modulated dimming value, and supplies the same to the timing controller 8. Thereby, the timing controller 8 aligns the modulated image data C_Data from the dimming controller 10, and supplies the same to the data driver 4. In this case, the dimming controller 10 further generates a drive signal PWM via modulation based on the output modulated dimming value, and supplies the same to the backlight unit 12. Hereinafter, an example in which the dimming controller 10 is provided separately from the timing controller 8 will be described in detail.

The dimming controller 10 detects an average gray-level value of the input image data RGB on a per at least one frame basis, and detects a maximum gray-level value on a per at least one frame basis. Then, the dimming controller 10 modulates the image data RGB using the average gray-level value, the maximum gray-level value, or any one value between the average gray-level value and the maximum gray-level value, and extracts a dimming value to control drive time of the backlight unit 12. The dimming controller 10 implements not only modulation of the image data RGB to enhance display resolution, but also control of drive time of the backlight unit 12, i.e. control of dimming using the extracted dimming value.

In particular, the dimming controller 10 sets the average gray-level value, the maximum gray-level value, or any one value between the average gray-level value and the maximum gray-level value to a reference value according to characteristics of the input image data RGB, i.e. characteristics of an entirely bright or dark image, an image having a particular bright or dark area, or a gradually brightly or darkly expressed image, and thereafter sets a dimming value based on the reference value. As a result of modulating the image data RGB based on the dimming value corresponding to characteristics of the image data RGB and controlling drive time of the backlight unit 12, it is possible to minimize display of poor or deteriorated images and enhance reduction efficacy of power consumption of the backlight unit 12. The dimming controller 10 of the present invention as described above will hereinafter be described in greater detail with reference to the accompanying drawings.

The backlight unit 12 includes a backlight 14 having plurality of light sources to emit light to the liquid crystal panel 2 and an optical unit to enhance luminous efficacy of light introduced from the respective light sources, and a backlight controller 16 to supply drive voltage Vled for driving of the respective light sources to the plurality of light sources in response to the drive signal (e.g., Pulse Width Modulation (PWM) signal) from the dimming controller 10.

The light sources of the backlight 14 are driven to generate light by the drive voltage Vled from the backlight controller 16, and the optical unit serves to enhance luminous efficacy via diffusion and condensation of light from the light sources. The backlight controller 16 is driven in a burst mode to turn on or off the respective light sources by supplying or intercepting the drive voltage Vled according to the drive signal PWM from the dimming controller 10.

Figure 2:
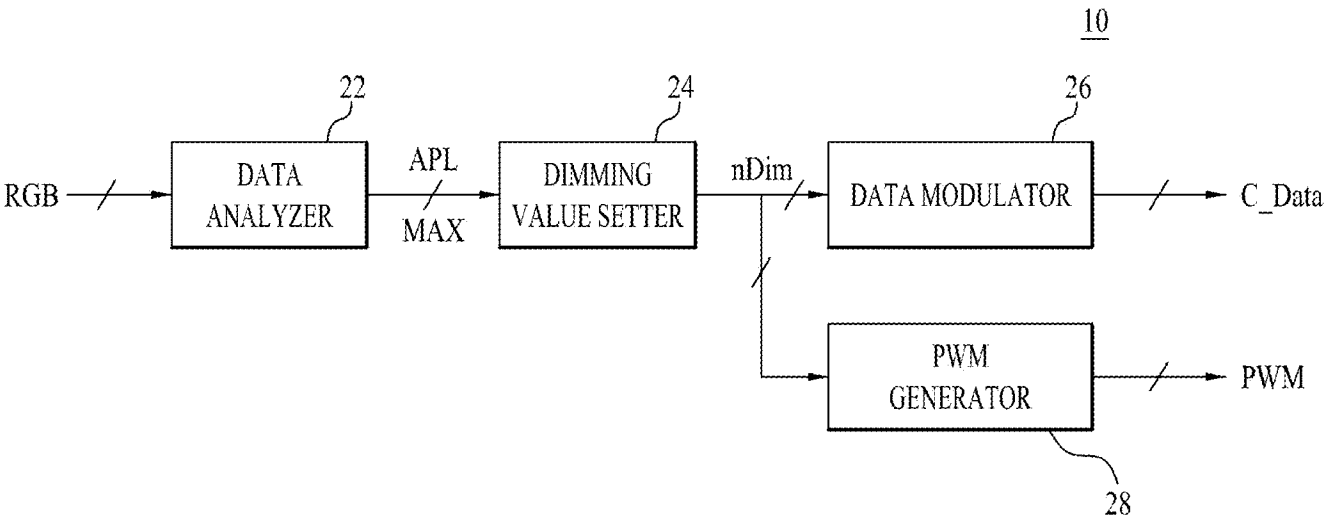
FIG. 2 is a view showing a detailed configuration of a dimming controller shown in FIG. 1.

FIG. 2 is a view showing a detailed configuration of the dimming controller shown in FIG. 1.

The dimming controller 10 as exemplarily shown in FIG. 2 includes a data analyzer 22 to detect an average gray-level value APL and a maximum gray-level value MAX of image data RGB input from the external source or the timing controller 8 on a per at least one frame basis, a dimming value setter 24 to output a dimming value n_Dim via modulation on a per at least one frame basis using the average gray-level value APL, the maximum gray-level value MAX, or any one value between the average gray-level value APL and the maximum gray-level value MAX detected on a per at least one frame basis, a data modulator 26 to generate modulated data C_Data by modulating the image data RGB from the external source or the timing controller 8 using the dimming value from the dimming value setter 24, and a PWM generator 28 to generate a drive signal PWM for conversion of a duty ratio based on the dimming value n_Dim from the dimming value setter 24 to thereby control drive time of the backlight unit 12.

The data analyzer 22 detects an average gray-level value APL and a maximum gray-level value MAX of image data RGB input from the external source or the timing controller 8 on a per at least one frame basis. Then, the data analyzer sequentially supplies the detected average gray-level value APL and the detected maximum gray-level value MAX to the dimming value setter 24.

The dimming value setter 24 outputs a dimming value n_Dim on a per at least one frame basis via modulation using the average gray-level value APL, the maximum gray-level value MAX, or any one value between the average gray-level value APL and the maximum gray-level value MAX detected on a per at least one frame basis.

Figure 3:
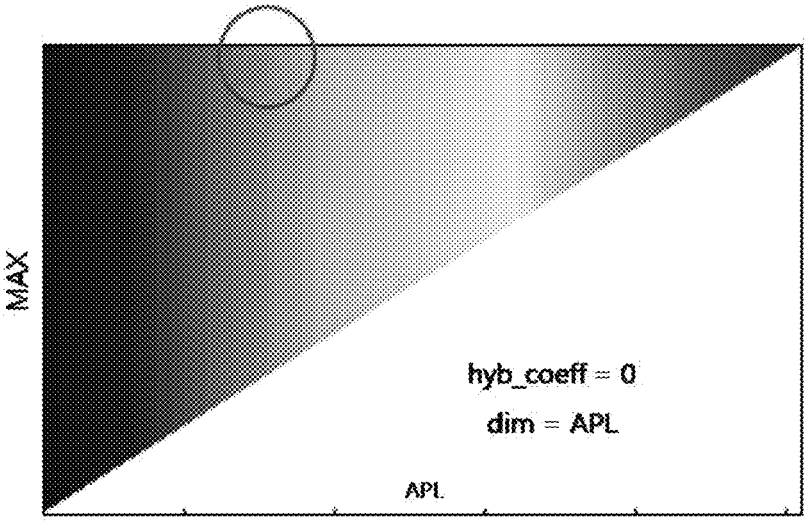
FIG. 3 is an explanatory view of characteristics of an image that is differently displayed according to dimming value setting of a dimming value setter shown in FIG. 2.
Figure 4:
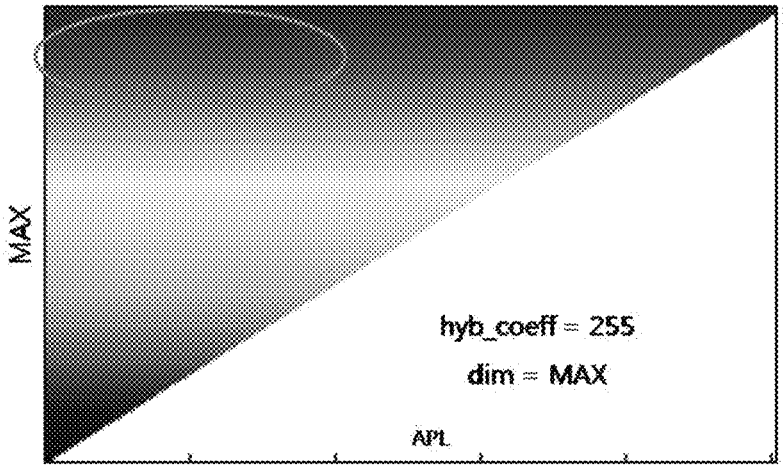
FIG. 4 is an explanatory view of characteristics of an image that is differently displayed according to dimming value setting of a dimming value setter shown in FIG. 2.

More specifically, the dimming value setter 24 has conventionally generated a dimming value n_Dim by dividing a differential value between the average gray-level value APL and the maximum gray-level value MAX by the maximum gray-level value MAX (e.g., 255), and thereafter adding the average gray-level value APL. However, in this case, the resulting dimming value n_Dim may increase deterioration of image quality due to, e.g., gray-level banding, although it reduces power consumption. In addition, as exemplarily shown in FIG. 3, if a coefficient hyb_coeff is not applied (hyb_coeff=0), i.e. if the dimming value n_Dim is set to be reduced to the maximum extent, a low dimming value n_Dim is applied even when it is necessary to display a bright portion, which causes display of an entirely dark image. As exemplarily shown in FIG. 4, if the dimming value n_Dim is set to be increased to the maximum extent, an entirely bright image is displayed, which increases power consumption.

To prevent deterioration of display resolution and reduce power consumption, the dimming value setter 24 may generate a dimming value n_Dim or dim by dividing a differential value between the average gray-level value APL and the maximum gray-level value MXA by the maximum gray-level value MAX, multiplying a predetermined coefficient, and adding the average gray-level value APL as represented by the following Equation 1.

$$\text{dim}=[\{(\text{MAX}-APL)/255\}\times hyb_\text{coeff}]+APL \qquad \text{Equation 1}$$

Here, hyb_coeff is a coefficient predetermined based on experimental values.

Figure 5:
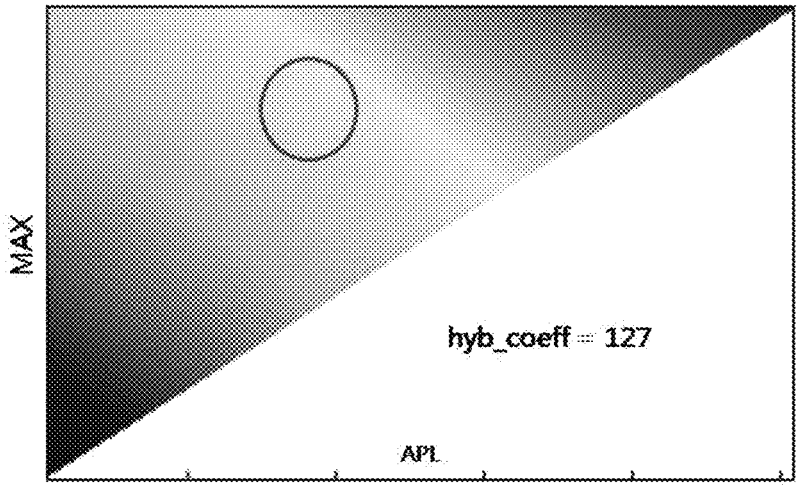
FIG. 5 is an explanatory view of characteristics of an image that is differently displayed according to dimming value setting of a dimming value setter shown in FIG. 2.

However, in the case of generating the dimming value n_Dim or dim using the above Equation 1, as exemplarily shown in FIG. 5, although deterioration of display resolution may be prevented, reduction efficacy of power consumption is less than that before the coefficient hyb_coeff is set to "zero". That is, an unnecessarily high dimming value n_Dim or dim is determined even in an image in which deterioration of image quality is not recognized, causing high power consumption.

To solve the above-described problem, the dimming value setter 24 may generate a dimming value n_Dim or dim by dividing a differential value between the average gray-level value APL and the maximum gray-level value MXA by the maximum gray-level value MAX, extracting the square of the resulting value, multiplying a predetermined coefficient, and adding the average gray-level value APL as represented by the following Equation 2.

$$\text{dim}=[\{(\text{MAX}-APL)/255\}^2\times hyb_\text{coeff}]+APL \qquad \text{Equation 2}$$

In the case of generating the dimming value n_Dim or dim using the above Equation 2, with respect to an image in which deterioration of image quality is not recognized, a value close to the average gray-level value APL is determined as the dimming value n_Dim or dim, which may reduce power consumption.

Figure 6:
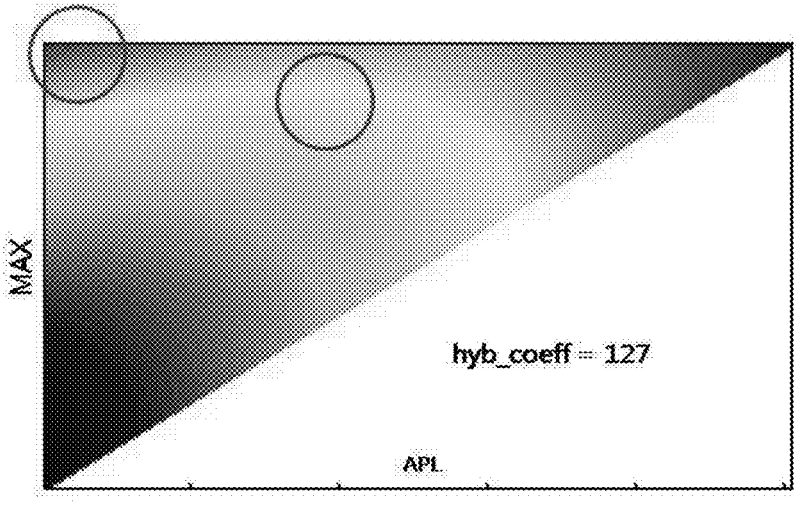
FIG. 6 is an explanatory view of characteristics of an image that is differently displayed according to dimming value setting of a dimming value setter shown in FIG. 2.

In the case of generating the dimming value n_Dim or dim using the above Equation 2, however, although it is possible to prevent the dimming value n_Dim or dim from being unnecessarily increased, as exemplarily shown in FIG. 6, a dark level image, more particularly, a slightly bright black level image may appear.

If the black level image appears, the dimming value setter 24 may adjust the dimming value n_Dim or dim based on the above Equation 1 or Equation 2 by adjusting the maximum gray-level value MAX using the following Equation 3.

$$\text{adj_MAX}=\text{MAX}-[\{(\text{MAX}-APL)/255\}^2\times(255-APL)]\times\text{adj_coeff} \qquad \text{Equation 3}$$

Here, adj_MAX replaces the maximum gray-level value MAX of Equation 1 or Equation 2.

As proposed by the following Equation 4, the dimming value setter 24 may generate the dimming value n_Dim or dim by replacing the maximum gray-level value MAX of Equation 2 with the maximum gray-level value adj_MAX adjusted based on the above Equation 3.

$$\text{dim}=[\{(\text{adj_MAX}-APL)/255\}^2\times hyb_\text{coeff}]+APL \qquad \text{Equation 4}$$

Figure 7:
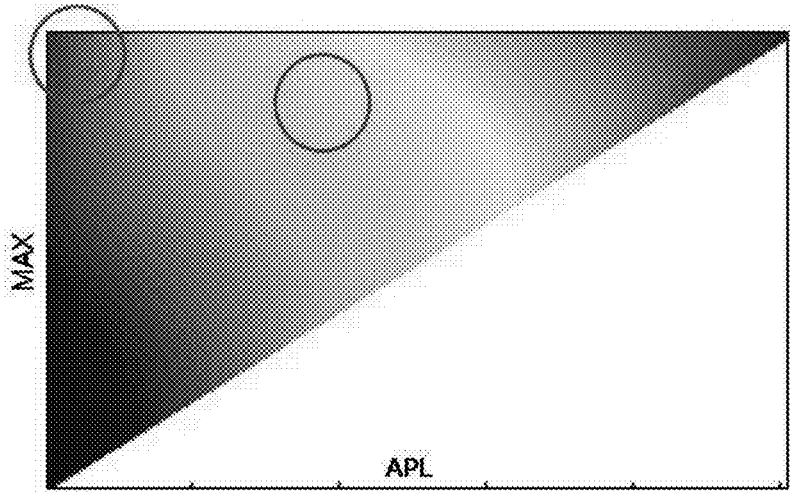
FIG. 7 is an explanatory view of characteristics of an image that is differently displayed according to dimming value setting of a dimming value setter shown in FIG. 2.

In the case of generating the dimming value n_Dim or dim using the above Equation 4, as exemplarily shown in FIG. 7, with respect to an image in which deterioration of image quality is not recognized, a value close to the average gray-level value APL may be determined as the dimming value n_Dim or dim, and it is possible to prevent appearance of a black level image and deterioration of display resolution. In particular, even if a particular portion of an entirely dark screen is slightly brightly displayed, it is possible to prevent the particular portion from becoming excessively bright.

Based on experimental results using the above Equation 4, it will be appreciated that prevention of image quality and reduction efficacy of power consumption are superior than those before the coefficient hyb_coeff is used, but reduction efficacy of power consumption is deteriorated as compared to the case of using only the average gray-level value APL.

Figure 8:
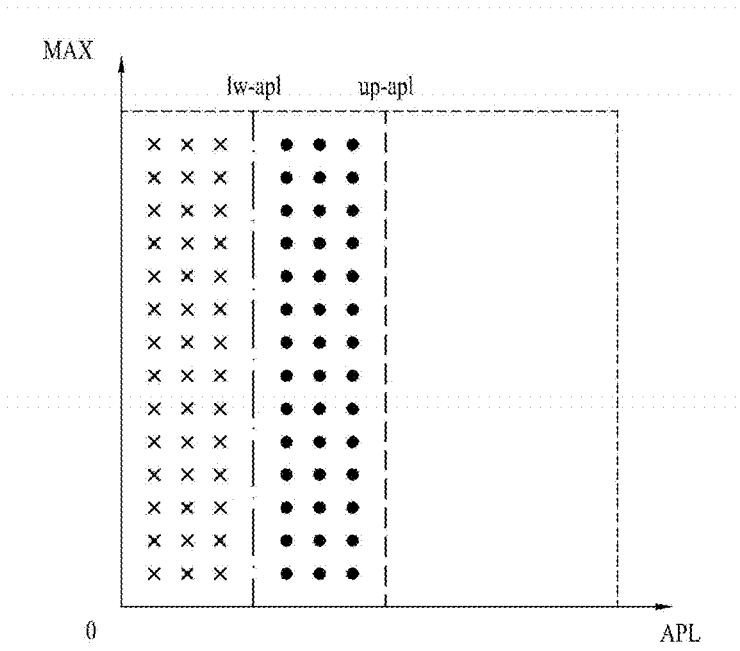
FIG. 8 is a graph showing the ranges of first and second threshold values predetermined by a dimming value setter shown in FIG. 2.

FIG. 8 is a graph showing the ranges of first and second threshold values predetermined by the dimming value setter shown in FIG. 2.

As exemplarily shown in FIG. 8, the dimming value setter 24 sets first and second threshold values 1*w*_ap1 and up_ap1 to achieve effects close to reduction of power consumption upon setting of the dimming value n_Dim using only the average gray-level value APL while minimizing deterioration of image quality. Here, the first and second threshold values 1*w*_ap1 and up_ap1 are reference values to differently select and apply setting of the dimming value n_Dim according to the range within which the detected average gray-level value APL is included.

That is, the dimming value setter 24 generates the dimming value n_Dim using only the average gray-level value APL if the average gray-level value detected by the data analyzer 22 is included within the range from a minimum gray-level value (zero gray-level) to the predetermined first threshold value 1*w*_ap1. In addition, the dimming value setter 24 generates a dimming value n_Dim using the following Equation 5 if the average gray-level value APL detected by the data analyzer 22 is greater than the first threshold value 1*w*_ap1 and less than the predetermined second threshold value up_ap1. Here, in the case of generating the dimming value n_Dim using the average gray-level value APL, the average gray-level value APL may be directly applied as the dimming value n_Dim.

$$dim=\frac{\text{Result of Eq. 4}-APL}{\text{up_apl}-\text{lw_apl}}*(APL-\text{lw_apl})+APL \qquad \text{Equation 5}$$

In addition, if the average gray-level value APL detected by the data analyzer 22 is included within the range from the second threshold value up_ap1 to the maximum gray-level value MAX, the dimming value setter 24 generates a dimming value n_Dim using the above Equation 4.

Figure 9:
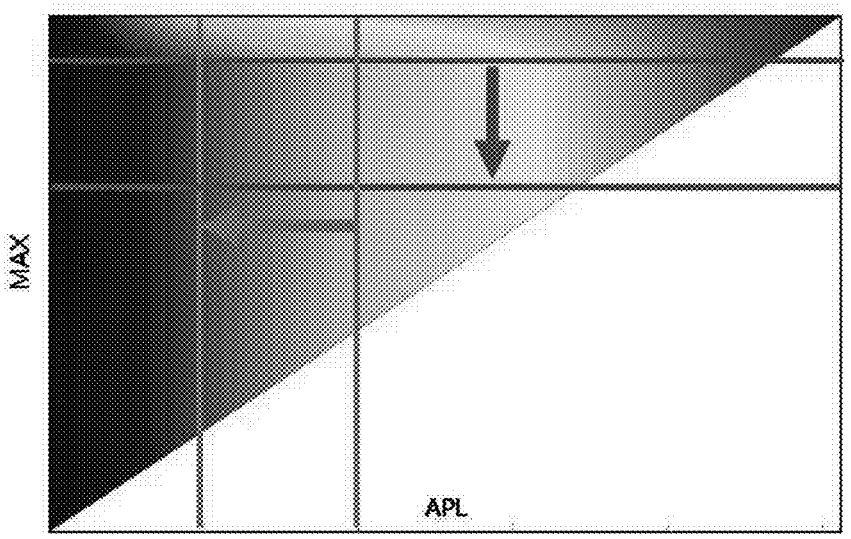
FIG. 9 is an explanatory view of characteristics of an image that is differently displayed according to dimming value setting of a dimming value setter shown in FIG. 2.

The first and second threshold values 1*w*_ap1 and up_ap1 may be set and used to control power consumption while minimizing deterioration of image quality via distinction of an image in which deterioration of image quality is recognized and an image in which deterioration of image quality is not recognized. In other words, as exemplarily shown in FIGS. 8 and 9, if the first and second threshold values 1*w*_ap1 and up_ap1 are set and the dimming value n_Dim is generated according to the range within which the average gray-level value APL detected by the data analyzer 22 is included, it is possible to achieve effects close to reduction of power consumption upon setting of the dimming value n_Dim using only the average gray-level value APL while minimizing deterioration of image quality.

Figure 10:
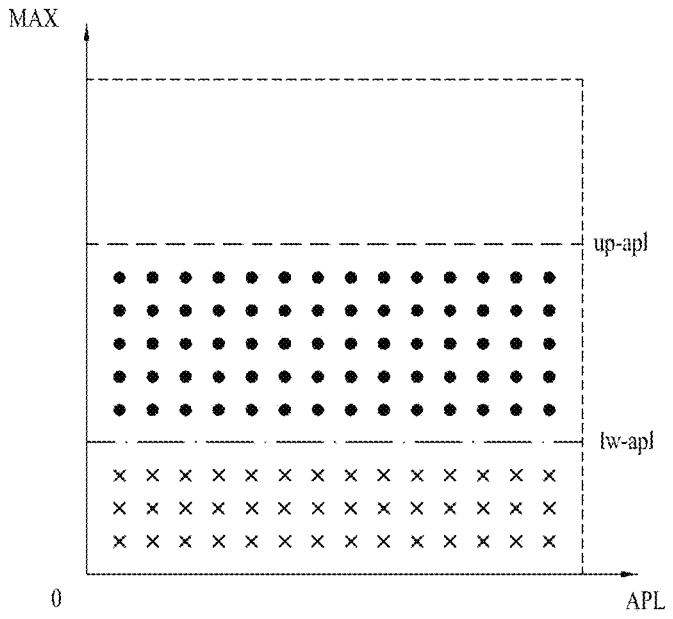
FIG. 10 is a graph showing the ranges of third and fourth threshold values predetermined by a dimming value setter shown in FIG. 2.

FIG. 10 is a graph showing the ranges of third and fourth threshold values predetermined by the dimming value setter shown in FIG. 2.

As exemplarily shown in FIG. 10, the dimming value setter 24 may generate a dimming value n_Dim based on the range within which the maximum gray-level value MAX detected by the data analyzer 22 is included, rather than generating a dimming value n_Dim based on the average gray-level value APL detected by the data analyzer 22.

Even in the case of generating the dimming value n_Dim based on the maximum gray-level value MAX detected by the data analyzer 22, third and fourth threshold values lw_max and up_max are set to achieve effects close to reduction of power consumption upon setting of the dimming value n_Dim using only the average gray-level value APL while minimizing deterioration of image quality. Here, the third and fourth threshold values lw_max and up_max are reference values to differently select and apply setting of the dimming value n_Dim according to the range within which the detected maximum gray-level value MAX is included.

That is, the dimming value setter 24 generates a dimming value n_Dim using only the average gray-level value APL if the maximum gray-level value MAX detected by the data analyzer 22 is included within the range from the minimum gray-level value (zero gray-level) to the predetermined third threshold value lw_max, and generates a dimming value n_Dim using the following Equation 6 if the maximum gray-level value MAX detected by the data analyzer 22 is greater than the third threshold value lw_max and less than the fourth threshold value up_max. Here, in the case of generating the dimming value n_Dim using only the average gray-level value APL, the average gray-level value APL may be directly applied as the dimming value n_Dim.

$$dim = \frac{\text{Results of Eq. 4 or Eq .5} - APL}{\text{up_max} - \text{lw_max}} * (\text{MAX} - \text{lw_max}) + APL \qquad \text{Equation 6}$$

Then, if the maximum gray-level value MAX detected by the data analyzer 22 is included within the range from the fourth threshold value lw_max to the maximum gray-level value (e.g., 255), the dimming value n_Dim is generated using the above Equation 4 or Equation 5.

The third and fourth threshold values lw_max and up_max may be set and used to control power consumption and to minimize deterioration of image quality via distinction of an image in which deterioration of image quality is recognized and an image in which deterioration of image quality is not recognized.

If the third and fourth threshold values lw_max and up_max are set and the dimming value n_Dim is generated according to the range within which the maximum gray-level value MAX detected by the data analyzer 22 is included, it is possible to achieve effects close to reduction of power consumption upon setting of the dimming value n_Dim using only the average gray-level value APL while minimizing deterioration of image quality.

As is apparent from the above description, a liquid crystal display device and a method of driving the same according to the embodiment of the present invention may achieve reduction of power consumption of a backlight unit via modulation of data of an image to be displayed to enhance display resolution. More particularly, according to the present invention, a dimming value is generated using a reference value corresponding to any one value within the range from an average gray-level value to a maximum gray-level value of image data based on characteristics of an image. Then, as image data is modulated and power consumption of a backlight unit is controlled based on the generated dimming value, it is possible to minimize deterioration of display resolution and maximize reduction efficacy of power consumption of the backlight unit.

It will be apparent that, although the preferred embodiments have been shown and described above, the disclosure is not limited to the above-described specific embodiments, and various modifications and variations can be made by those skilled in the art without departing from the gist of the appended claims. Thus, it is intended that the modifications and variations should not be understood independently of the technical sprit or prospect of the invention.

What is claimed is:

1. A liquid crystal display device comprising:

a liquid crystal panel having a plurality of pixel areas to display an image;

a data driver configured to drive data lines of the liquid crystal panel;

a dimming controller configured to generate a dimming value via modulation using any one value within a range from an average gray-level value to a maximum gray-level value of image data input from an external source, and to modulate the image data into modulated image data based on the dimming value and control drive time of a backlight unit based on the dimming value;

a timing controller configured to allow transmission of the image data modulated by the dimming controller to the data driver, and to control the data driver; and the backlight unit configured to emit light to the liquid crystal panel in response to a drive signal from the dimming controller, wherein the dimming controller includes:

a data analyzer configured to detect the average gray-level value and the maximum gray-level value of image data input from the external source or the timing controller on a per at least one frame basis;

a dimming value setter configured to output the dimming value via modulation on a per at least one frame bases using the average gray-level value, the maximum gray-level value, or any one value between the average gray-level value and the maximum gray-level value detected on a per at least one frame basis;

a data modulator configured to generate the modulated data by modulating the image data from the external source or the timing controller using the dimming value from the dimming value setter, the data driver driving the data lines based on the modulated image data; and a Pulse Width Modulation (PWM) generator configured to generate the drive signal for conversion of a duty ratio based on the dimming value from the dimming value setter to thereby control drive time of the backlight unit.

2. The device according to claim 1, wherein the dimming value setter generates the dimming value by dividing a differential value between the average gray-level value and the maximum gray-level value by the maximum gray-level value, multiplying a predetermined coefficient, and adding the average gray-level value as represented by the following Equation 1:

$$\text{dim}=[\{(\text{MAX}-APL)/255\}\times hyb_\text{coeff}]+APL \qquad \text{Equation 1}$$

where hyb_coeff is a coefficient predetermined based on experimental values, or the dimming value setter generates the dimming value by dividing a differential value between the average gray-level value and the maximum gray-level value by the maximum gray-level value, extracting the square of the resulting value, multiplying a predetermined coefficient, and adding the average gray-level value as represented by the following Equation 2:

$$\text{dim}=[\{(\text{MAX}-APL)/255\}^2\times hyb_\text{coeff}]+APL, \qquad \text{Equation 2}$$

wherein the dimming value setter adjusts the dimming value based on the above Equation 1 or Equation 2 by adjusting the maximum gray-level value using the following Equation 3:

$$\text{adj_MAX}=\text{MAX}-[\{(\text{MAX}-APL)/255\}^2\times(255-APL)]\times\text{adj_coeff} \qquad \text{Equation 3}$$

where adj_MAX replaces the maximum gray-level value of Equation 1 or Equation 2, and wherein the dimming value setter generates the dimming value by replacing the maximum gray-level value of Equation 2 with the maximum gray-level value adjusted based on the above Equation 3 as described by the following Equation 4:

$$\text{dim}=[\{(\text{adj_MAX}-APL)/255\}^2\times hyb_\text{coeff}]+APL \qquad \text{Equation 4.}$$

3. The device according to claim 2, wherein the dimming value setter includes predetermined first and second threshold values as reference values to differently select and apply setting of the dimming value according to the range within which the detected average gray-level value is included, wherein, if the detected average gray-level value is included within the range from a minimum gray-level value to the predetermined first threshold value, the dimming value setter generates the dimming value using only the average gray-level value, wherein, if the detected average gray-level value is greater than the first threshold value and less than the predetermined second threshold value, the dimming value setter generates the dimming value using the following Equation 5:

$$dim=\frac{\text{Result of Eq. 4}-APL}{\text{up_apl}-\text{lw_apl}}*(APL-\text{lw_apl})+APL, \qquad \text{Equation 5}$$

and wherein, if the detected average gray-level value is included within the range from the second threshold value to the maximum gray-level value, the dimming value setter generates the dimming value using the above Equation 4.

4. The device according to claim 2, wherein the dimming value setter includes predetermined third and fourth threshold values as reference values to differently select and apply setting of the dimming value according to the range within which the detected maximum gray-level value is included, wherein, if the detected maximum gray-level value is included within the range from the minimum gray-level value (zero gray-level) to the predetermined third threshold value, the dimming value setter generates the dimming value using only the average gray-level value, wherein, if the detected maximum gray-level value is greater than the third threshold value and less than the fourth threshold value, the dimming value setter generates the dimming value using the following Equation 6:

$$dim=\frac{\text{Results of Eq. 4 or Eq. 5}-APL}{\text{up_max}-\text{lw_max}}*(\text{MAX}-\text{lw_max})+APL, \qquad \text{Equation 6}$$

and wherein, if the detected maximum gray-level value is included within the range from the fourth threshold value to the maximum gray-level value, the dimming value setter generates the dimming value using the above Equation 4 or Equation 5.

5. A method of driving a liquid crystal display device, the method comprising:

driving gate and data lines of a liquid crystal panel;

generating a dimming value via modulation using any one value within a range from an average gray-level value to a maximum gray-level value of image data input from an external source or a timing controller, and modulating the image data into modulated image data based on the dimming value and controlling drive time of a backlight unit based on the dimming value;

allowing transmission of the modulated image data to a data driver, and controlling the data driver; and emitting light to the liquid crystal panel in response to a drive signal generated to control drive time of the backlight unit, wherein outputting the image data via modulation and controlling drive time of the backlight unit includes:

detecting the average gray-level value and the maximum gray-level value of the image data on a per at least one frame basis;

outputting the dimming value via modulation on a per at least one frame bases using the average gray-level value, the maximum gray-level value, or any one value between the average gray-level value and the maximum gray-level value detected on a per at least one frame bases;

generating the modulated image data by modulating the image data using the output modulated dimming value; and generating the drive signal for conversion of a duty ratio based on the output modulated dimming value to thereby control drive time of the backlight unit.

6. The method according to claim 5, wherein, upon outputting the dimming value via modulation, the dimming value is generated by dividing a differential value between the average gray-level value and the maximum gray-level value by the maximum gray-level value, multiplying a predetermined coefficient, and adding the average gray-level value as represented by the following Equation 1:

$$\text{dim}=[\{(\text{MAX}-APL)/255\}\times hyb_\text{coeff}]+APL \quad \text{Equation 1}$$

where hyb_coeff is a coefficient predetermined based on experimental values), or the dimming value is generated by dividing a differential value between the average gray-level value and the maximum gray-level value by the maximum gray-level value, extracting the square of the resulting value, multiplying a predetermined coefficient, and adding the average gray-level value as represented by the following Equation 2:

$$\text{dim}=[\{(\text{MAX}-APL)/255\}^2\times hyb_\text{coeff}]+APL, \quad \text{Equation 2}$$

wherein the dimming value based on the above Equation 1 or Equation 2 is adjusted by adjusting the maximum gray-level value using the following Equation 3:

$$\text{adj_MAX}=\text{MAX}-[\{(\text{MAX}-APL)/255\}^2\times(255-APL)]\times\text{adj_coeff} \quad \text{Equation 3}$$

where adj_MAX replaces the maximum gray-level value of Equation 1 or Equation 2, and wherein the dimming value is generated by replacing the maximum gray-level value of Equation 2 with the maximum gray-level value adjusted based on the above Equation 3 as described by the following Equation 4:

$$\text{dim}=[\{(\text{adj_MAX}-APL)/255\}^2\times hyb_\text{coeff}]+APL \quad \text{Equation 4.}$$

7. The method according to claim 6, wherein, upon outputting the dimming value via modulation, based on predetermined first and second threshold values as reference values to differently select and apply setting of the dimming value according to the range within which the detected average gray-level value is included, if the detected average gray-level value is included within the range from a minimum gray-level value to the predetermined first threshold value, the dimming value is generated using only the average gray-level value, if the detected average gray-level value is greater than the first threshold value and less than the predetermined second threshold value, the dimming value is generated using the following Equation 5:

$$dim=\frac{\text{Result of Eq. 4}-APL}{\text{up_apl}-\text{lw_apl}}*(APL-\text{lw_apl})+APL, \quad \text{Equation 5}$$

and if the detected average gray-level value is included within the range from the second threshold value to the maximum gray-level value, the dimming value is generated using the above Equation 4.

8. The method according to claim 6, wherein, upon outputting the dimming value via modulation, based on predetermined third and fourth threshold values as reference values to differently select and apply setting of the dimming value according to the range within which the detected maximum gray-level value is included, if the detected maximum gray-level value is included within the range from the minimum gray-level value (zero gray-level) to the predetermined third threshold value, the dimming value is generated using only the average gray-level value, if the detected maximum gray-level value is greater than the third threshold value and less than the fourth threshold value, the dimming value is generated using the following Equation 6:

$$dim=\frac{\text{Results of Eq. 4 or Eq. 5}-APL}{\text{up_max}-\text{lw_max}}*(\text{MAX}-\text{lw_max})+APL, \quad \text{Equation 6}$$

and if the detected maximum gray-level value is included within the range from the fourth threshold value to the maximum gray-level value, the dimming value is generated using the above Equation 4 or Equation 5.

* * * * *